US012234607B2

(12) United States Patent
Aydin

(10) Patent No.: US 12,234,607 B2
(45) Date of Patent: Feb. 25, 2025

(54) BIOCOMPOSITE MATERIAL

(71) Applicant: ORGANOCLICK AB, Täby (SE)

(72) Inventor: Juhanes Aydin, Södertälje (SE)

(73) Assignee: ORGANOCLICK AB, Täby (SE)

( * ) Notice: Subject to any disclaimer, the term of this patent is extended or adjusted under 35 U.S.C. 154(b) by 351 days.

(21) Appl. No.: 17/312,133

(22) PCT Filed: Dec. 13, 2019

(86) PCT No.: PCT/SE2019/051277
§ 371 (c)(1),
(2) Date: Jun. 9, 2021

(87) PCT Pub. No.: WO2020/122805
PCT Pub. Date: Jun. 18, 2020

(65) Prior Publication Data

US 2022/0112662 A1 Apr. 14, 2022

(30) Foreign Application Priority Data

Dec. 14, 2018 (SE) ..... 1851589-0

(51) Int. Cl.

| | |
|---|---|
| ***D21H 15/10*** | (2006.01) |
| ***D21H 11/12*** | (2006.01) |
| ***D21H 17/02*** | (2006.01) |
| ***D21H 17/29*** | (2006.01) |
| ***D21H 21/18*** | (2006.01) |

(52) U.S. Cl.
CPC ..... *D21H 15/10* (2013.01); *D21H 11/12* (2013.01); *D21H 17/02* (2013.01); *D21H 17/29* (2013.01); *D21H 21/18* (2013.01)

(58) Field of Classification Search
CPC ..... D21H 15/10; D21H 11/12; D21H 17/02; D21H 17/29; D21H 21/18
USPC ..... 162/158
See application file for complete search history.

(56) References Cited

U.S. PATENT DOCUMENTS

| | | | | |
|---|---|---|---|---|
| 675,234 | A | 5/1901 | McMullen | |
| 4,110,287 | A * | 8/1978 | Bosso | C08G 59/5053 523/426 |
| 5,593,625 | A | 1/1997 | Riebel et al. | |
| 9,334,610 | B2 | 5/2016 | Kinnunen et al. | |
| 2018/0313039 | A1 | 11/2018 | Tuszkiewicz et al. | |

FOREIGN PATENT DOCUMENTS

| | | | |
|---|---|---|---|
| CN | 104302834 | A | 1/2015 |
| EP | 0554659 | A1 | 8/1993 |
| EP | 0976790 | A1 | 2/2000 |
| EP | 1967338 | A1 | 9/2008 |
| JP | H1-162899 | A | 6/1989 |
| JP | 5-263392 | A | 10/1993 |
| JP | 7-145592 | A | 6/1995 |
| WO | 00/06550 | A1 | 2/2000 |

OTHER PUBLICATIONS

CSmold, "Exploring the Differences: Compression Molding vs. Thermoforming", [online], retrieved from the internet, [retrieved Jul. 15, 2024],3 pages, 2022, <URL:https://www.csmolding.com/companies/exploring-the-differences-compression-molding-vs-thermoforming/. (Year: 2022).*

Search Report from corresponding European Application No. 19894512.3 dated Jul. 19, 2022.

Modzelewska, Izabela et al., Application of Cereal Bran in Production of Paper Products—Initial Investigations, Acta Sci. Pol., vol. 5, No. 2, pp. 175-184 (2006).

Modzelewska, Izabela et al., Effect of the Addition of Pesticide on the Biodegradation Rate by Microfungi of Paper Articles Supplemented with Cereal Bran and their Breaking Strength, Folia Forestalia Polonica, Series B, Issue 41, pp. 69-79 (2010).

Rahman Atikur et al., Pretreatment of Wheat Bran for Suitable Reinforcement in Biocomposites, J. Renew Mater. Supplement, pp. 1-12 (Jun. 2017).

Official Action from corresponding Swedish Application No. 1851589-0 dated May 22, 2019.

Office Action from corresponding Japanese Application No. 2021-532830 dated Oct. 31, 2023 English Translation.

Didone et al., "Moulded Pulp Manufacturing: Overview and Prospects for the Process Technology," Packaging Technology and Science, 30: 231-249 (2017).

Search Report dated Apr. 22, 2022 from corresponding Chinese Application No. 201980087151.6.

* cited by examiner

*Primary Examiner* — Dennis R Cordray
(74) *Attorney, Agent, or Firm* — Porter Wright Morris & Arthur LLP

(57) ABSTRACT

The present invention relates generally to biocomposite materials made of cellulose and wheat bran and/or oat husk, prepared by methods comprising mixing the husk or bran with an aqueous alkaline solution, stirring and/or homogenizing the mixture, admixing with cellulose pulp and thermoforming the material under conditions admitting curing, thereby obtaining improvements in strength measured as at least one of strain at peak (%), stress at peak (%) and Young's modulus (MPa).

12 Claims, No Drawings

BIOCOMPOSITE MATERIAL

TECHNICAL FIELD

The present invention relates generally to biocomposite materials made of cellulose and wheat bran and/or oat husk, and methods to produce such materials.

BACKGROUND OF THE INVENTION

Wheat bran and oat husk or hulls are two interesting cheap waste stream materials from the agriculture industry with a big potential to be used in future sustainable materials. Both the low price and their availability are attractive factors together with their esthetic properties as part of the final products. In the publication by A. Rahman et al. in *J. Renew Mater*. Supplement June 2017, pp 63-73, different ways of treating wheat bran are analyzed and compared. It was observed that both sodium hydroxide and sulfuric acid solubilized hemicelluloses and the remaining fractions were analyzed for cellulose lignin, starch, fat and protein. However, no particular guidelines are disclosed on how to produce improved biocomposite materials beyond generally suggesting the usefulness of the fibers resulting from the treatments as a suitable reinforcing material. Several documents disclose oat husks useful either alone or as an additive to cellulose fibers to make composite boards. U.S. Pat. No. 675,234 discloses box boards from oat husks cooked with lime. EP1967338 discloses a board material comprising unprocessed oat husks and wood chips, fibers or strands compressed with a binder. EP 976790 also discloses a process to make a composite from cereal brans, husks or hulls in a thermoplastic processing step with a bonding agent. Acta Sci Pol 2006, vol. 5, pp 175-184, US 2018/0313039 and JPH 07145592 disclose cereal bran or chaff as a filler in a paper making process while improvements in certain strength parameters are reported, but no formed composite materials are disclosed, wherein the brans are processed in order to improve material strength. EP 096790 discloses a thermoplastic process of vegetable material useful in forming different shapes. It therefore remains to provide a composite material of cellulose and wheat bran and/or oat husk that can be processed with conventional methods and paper making processes to act as a binder without any additional adhesive binders, while improving the mechanical properties compared to a composite material of cellulose fibers alone. The present invention is directed such a process and a resulting molded biocomposite product.

DESCRIPTION OF THE INVENTION

It is an object of the present invention to provide improvements in composite materials by decreasing the use of costly fibers (reduce costs), increase or at least maintain the mechanical properties and at the same time provide an esthetically appealing appearance of the products.

It is an object of the present invention to accomplish the improvements under conditions and with methods that are conventional in pulp industry and manufacturing and that are compatible with the wet end of pulp and paper production.

It is an object of the present invention to accomplish the improvements in composite materials without employing a chemical binding agent or the addition of adhesives.

It is also an object of the invention to provide compatibility with currently used chemicals and conventional procedures known in the art of pulp and paper production.

Generally the invention is directed to biocomposite materials and methods of producing such materials, wherein the method includes a pretreatment step of the brans and husks or hulls in order prepare a bioadditive to be added with cellulose pulp or fibers from wood, as prepared with conventional process.

A biocomposite material in this context has the usual meaning of composite materials which is a material made from two or more constituent materials from natural or biological sources with different physical or chemical properties that, when combined, produce a material with characteristics different from at least one of the individual components.

In the context of the present invention, brans and husks or hulls has the meaning of the outer shell or coating of a seed fruit or vegetable, especially from cereals, such as the bran hard outer layer of cereal grains. The cellulose used with the present invention typically comes from wood, plants, agriculture of vegetables, fruits, algae, fungi, bacteria and tunicates.

In a first general aspect, the invention is directed to a biocomposite material comprising cellulose fibers and a bioadditive from husks or brans, preferably from cereals having at least the same strength as the corresponding material comprising same cellulose fibers in the same amount, but without the bioadditives, wherein the biocomposite material is free from any additional binder, and wherein the strength is measured as at least one of strain at peak (%), stress at peak (%) and Young's modulus (MPa).

In this context, the term "free from any additional binder" means that the biocomposite does not include any conventional chemical and/or adhesive agent conventionally employed in the production of composite materials, such as butadiene copolymers, acrylates, vinyl copolymers (acrylic, styrenated acrylics, polyvinyl acetate, vinylacrylics, ethylene vinyl acetate, styrene butadiene, poly vinyl chloride and ethylene/vinyl chloride), epoxy, polyester or phenolic resins and isocyanates. The skilled person will accordingly readily give the term binder-free a significant meaning. Preferably, in this first aspect, the biocomposite material comprises a bioadditive derived from at least one of wheat brans and oat husks. Preferably, the biocomposite material comprises 75% (wt) or less of the bioadditive, preferably 5 to 50% (wt).

In another general aspect, the present invention is directed to a process of preparing a biocomposite material comprising a bioadditive from cereal husks and/or brans. The process comprises the steps of mixing the husks and/or brans with an aqueous alkaline solution, i.e. with a pH of at least 7, in order to provide a bioadditive with a step representing a pretreatment of the cereal brans and/or husks; followed by admixing the bioadditive with a dispersion of cellulose pulp to provide a the material of the biocomposite; and thereafter forming the biocomposite. In the process, the aqueous alkaline solution preferably comprises least 0.5% (wt) NaOH, more preferably 0.5 to 5% (wt) NaOH. The forming of the biocomposite can be performed with a moulded pulp process or a paper making process as conventionally employed in the field of technology. For example, useful moulded pulp processes (MPPs) are classified by International Molded Fiber Association (IMFA) as "Thick wall", "Transfer moulded", "Thermoformed (Thin Wall)", and "Processed", see also Moulded Pulp Manufacturing: Overview and Prospects for the Process Technology Didone, Mattia; Saxena, Prateek; Meijer, Ellen Brilhuis; Tosello, Guido; Bissacco, Giuliano; McAloone, Tim C.; Pigosso, Daniela Cristina Antelmi; Howard, Thomas J. Published in:

Packaging Technology and Science Link to article, DOI: 10.1002/pts.2289 Publication date: 2017.

In one aspect, the above disclosed processes comprise a thermoforming step.

In one aspect, the above disclosed processes can further comprise compressing the biocomposite material in a mould at an elevated temperature and at an elevated pressure, thereby curing said biocomposite material. For example, by forming different types of bonds within the material.

In aspect of the inventive process, it comprises collecting the water soluble fraction of the bioadditive preparation and admixing it with the dispersion of cellulose pulp.

In one aspect of the processes as mentioned, the ratio of cereal husk or bran to aqueous alkaline solution in the mixing step is from at least 1:1 to 1:100, preferably 1:3 to 1:20, and most preferably 1:5 to 1:10. Preferably, the mixing step comprises stirring and/or homogenization wherein the rpm is 30000 rpm or less. For example the rpm can between 5000 and 30000.

In one aspect of the processes as mentioned, the cereal husks or brans are selected from at least one of wheat brans and oat husks.

In one aspect of the process an additive is added selected from at least one of cationic starch; AKD (alkylketene dimer); ASA (alkenylsuccinic anhydride); PLA (poly lactic acid); dyes; fillers; pigments; wet strength increasing agents; defoamers; preservatives; biocides and other conventional agents used in pulp industry such as clays, waxes and similar agents. Such an additive can added either in the pre-treatment step when providing the bioadditive or the admixing step between cellulose fibres and bioadditive, or in both steps of the earlier disclosed processes.

In one aspect, the processes as described to prepare a biocomposite material comprises the steps of diluting the mixture of bioadditive and cellulose pulp to a level of 0.25 to 2% dry fiber, preferably to 1% dry fiber; collecting the mixture in sieve or on a filter or a woven fabric, of the kind conventionally used in papermaking machines; and transferring the collected mixture to the forming step. Preferably, the forming step is thermoforming as earlier described. Finally, the invention is directed to a biocomposite material as disclosed produced by any of the mentioned processes (i.e. a product-by-process).

DETAILED AND EXEMPLIFYING DESCRIPTION OF THE INVENTION

In the following, a detailed description of invention methods and products are outlined together with embodiments of the invention. Wheat bran and oat husk contains cellulose, lignin, hemicelluloses (xylans and arabinoxylans), phenolic compounds such as ferulic acids, minerals and proteins. The mechanical and alkaline pre-treatments facilitates the extraction of the hemicelluloses and present invention exploit their potential as a bioadditive to contribute to an increase in mechanical properties of the produced biocomposites. Several different methods of preparing bioadditives with pre-treatments were tested and different cellulose fibers were also investigated. All the experiments are summarized in the tables below.

Different Pre-Treatments

Reference: 25 g of CTMP was disintegrated in 2 L of tap water at 30.000 rpm using a PTI Austria disintegrator. Hand sheets were made using Rapid Köthen. After formation the wet hand sheets were pressed with 10 tons pressure for 5 minutes and dried for 10 minutes at 95° C. Final oven drying at 170° C. for 5 minutes. Mechanical properties was measured using a Testometric M25-2.5AT.

Pre-treatment: Pretreatment of wheat bran from Lantmännen was performed according to the table below. An Ika Ultra Turrax was used for the mixing of 5 g wheat bran with 35 g of water containing the different chemicals in Table 1. The mixing time was 30 min and the speed was adjusted to 2 different levels. After the mixing was completed the wheat bran was added to the CTMP pulp. Hand sheets were produced exactly the same way as the reference except that 20 g CTMP instead of 25 was used.

TABLE 1

| | CTMP (g) | Wheat bran (g) | Additive (g) | Procedure | Mixing speed (rpm) |
|---|---|---|---|---|---|
| Ref | 25 | — | — | | — |
| a) | 20 | 5 | — | | — |
| b) | 20 | 5 | — | | 6.000 |
| c) | 20 | 5 | — | | 17.000 |
| d) | 20 | 5 | 0.5% NaOH | | — |
| e) | 20 | 5 | 0.5% NaOH | | 6.000 |
| f) | 20 | 5 | 0.5% NaOH | | 17.000 |
| g) | 20 | 5 | 0.5% $K_2CO_3$ | | 6.000 |
| h) | 20 | 5 | 5% citric acid | | 6.000 |
| i) | 20 | 5 | 0.5% $H_2SO_4$ | | 6.000 |
| j-1) | 20 | 5 | 2% NaOH | separated filtrate | 6.000 |
| j-2) | 20 | 5 | 2% NaOH | wheat bran fraction | 6.000 |
| k) | 20 | 5 | 1% NaOH | | 6.000 |
| l) | 20 | 5 | 2.5% NaOH | | 6.000 |
| m) | 20 | 5 | 5% NaOH | | 6.000 |

TABLE 2

Standard deviation is given in parentheses

| | Weight (g) | Strain at peak (%) | Stress at peak (MPa) | Young's modulus (MPa) |
|---|---|---|---|---|
| Ref | 24.14 | 2.144 (0.228) | 11.21 (1.025) | 760.7 (56.84) |
| a) | 23.4 | 2.088 (0.383) | 10.34 (1.254) | 721.22 (46.605) |
| b) | 22.63 | 2.336 (0.218) | 14.05 (0.706) | 905.6 (29.431) |
| c) | 22.54 | 2.627 (0.439) | 17.25 (1.80) | 974.66 (48.69) |
| d) | 22.81 | 2.311 (0.123) | 15.37 (0.357) | 932.77 (21.624) |
| e) | 22.43 | 2.381 (0.497) | 17.01 (1.99) | 1015.19 (48.80) |
| f) | 21.90 | 2.488 (0.29) | 21.54 (2.375) | 1258.419 (19.42) |
| g) | 23.13 | 2.032 (0.393) | 12.54 (1.79) | 785.629 (36.78) |
| h) | Not measured | 1.813 (0.277) | 9.16 (1.03) | 663.521 (35.72) |

TABLE 2-continued

Standard deviation is given in parentheses

| | Weight (g) | Strain at peak (%) | Stress at peak (MPa) | Young's modulus (MPa) |
|---|---|---|---|---|
| i) | 23.20 | 2.01 (0.339) | 11.04 (1.241) | 713.762 (11.99) |
| j-1) | 19.60 | 2.564 (0.237) | 19.26 (0.974) | 1129.8 (41.041) |
| j-2) | 21.19 | 1.978 (0.214) | 12.38 (0.987) | 842.91 (24.180) |
| k) | 22.01 | 2.63 (0.388) | 17.886 (1.33) | 1075.682 (33.805) |
| l) | 21.97 | 2.221 (0.256) | 15.197 (1.075) | 999.924 (51.518) |
| m) | 21.61 | 2.51 (0.515) | 18.091 (2.455) | 1210.492 (24.247) |

No increase in strength was observed for the non-pre-treated wheat bran without mechanical stirring (a, table 2). However, compatibility between the fibers and the wheat bran was good and the reduction in fiber usage was about 20%. Mechanical mixing alone of wheat bran without additives increased strength (b and c, table 2). More intense mixing gave higher strength for the hand sheets. Sodium hydroxide pre-treatment (0.5%) gave higher strength compared to neutral conditions. Also here the amount of mixing had an effect on the strength. More intense mixing gave stronger hand sheets (d, e and f, table 2). Acidic pre-treatments had no effect on the final strength (h and j, table 2). In one experiment (j-1 and j-2, table 2), the particles were separated from the solution after the 0.5% sodium hydroxide pre-treatment. Hand sheets were made from both the solid fraction and the water soluble fraction. It is clear that most of the strength increase comes from the dissolved material from the wheat bran pre-treatment (j-1, table 2). Hemicelluloses such as Arabinoxylans are probably extracted from the wheat bran during the pre-treatment and these polysaccharides adsorb to the cellulose fibers in the "wet end" during the paper making, with improved mechanical properties of the produced hand sheets. Different sodium hydroxide concentrations did not have a significant effect on the hand sheet strength (k, l and m, Table 2).

Different Fibers

Wheat bran was treated with 0.5% NaOH. A Water-wheat bran ratio of 7:1 was used. Mixing was performed at 20.000 rpm for 30 min using an Ika Ultra Turrax. 40 g of this pre-treated wheat bran was mixed with 20 g of different pulps according to the Table 3 below. Hand sheets were produced as described in the section above. 20 g of the pulp together with the pre-treated wheat bran was disintegrated in 2 L of tap water at 30.000 rpm. Hand sheets were made using Rapid Köthen. After formation the wet hand sheets were pressed with 10 tons pressure for 5 minutes and dried for 10 minutes at 95° C. Final oven drying at 170° C. for 5 minutes. 25 g of pulp was used as a reference without wheat bran.

TABLE 3

A strength increase was observed for all the pulps with pre-treated wheat bran.

| | Wheat bran (%) | Weight (g) | Strain at peak (%) | Stress at peak (MPa) | Young's modulus (MPa) |
|---|---|---|---|---|---|
| CTMP | — | 24.14 | 2.14 | 11.21 | 760.7 |
| CTMP | 20 | 21.92 | 2.6 | 17.42 | 989 |
| Bleached soft wood kraft pulp | — | 24.94 | 3.75 | 16.84 | 1109.2 |
| Bleached soft wood | 20 | 22.58 | 5.23 | 24.94 | 1407.1 |

TABLE 3-continued

A strength increase was observed for all the pulps with pre-treated wheat bran.

| | Wheat bran (%) | Weight (g) | Strain at peak (%) | Stress at peak (MPa) | Young's modulus (MPa) |
|---|---|---|---|---|---|
| kraft pulp | | | | | |
| Unbleached soft wood kraft pulp | — | 24.80 | 2.86 | 16.27 | 1136.1 |
| Unbleached soft wood kraft pulp | 20 | 22.93 | 4.75 | 26.86 | 1512.1 |
| Bleached hard wood kraft pulp (birch) | — | 24.75 | 2.35 | 19.21 | 1415.7 |
| Bleached hard wood kraft pulp (birch) | 20 | 23.02 | 4.00 | 32.6 | 1800.7 |
| Dissolving pulp (Domsjo) | — | 24.21 | 2.40 | 6.4 | 481.3 |
| Dissolving pulp (Domsjo) | 20 | 22.28 | 3.09 | 9.46 | 642.5 |
| Abaca Celtex B TCF | | 24.61 | 4.72 | 21.52 | 1142 |
| Abaca Celtex B TCF | 20 | 22.61 | 5.62 | 27.57 | 1343 |

Different Additives Together with Pre-Treated Wheat Bran

The table below (Table 4) describes how different additives added in the "wet end" together with CTMP pulp and pre-treated wheat bran affects the final composite materials. Cationic starch further improves the mechanical properties compared to the wheat bran reference. AKD added as an emulsion also improved the strength and dramatically improved the hydrophobicity resulting in a Cobb60 value below 20. Old wheat bran containing preservatives stored for two months at room temperature gave lower strength increase compared to freshly prepared pre-treated wheat bran. The reason for this could be that the polysaccharides improving the strength, degrade over time. Antifoaming agent (Dispelair CF56) in the formulation lowers the strength of the produced hand sheets.

TABLE 4

| | Additive amount | CTPM | Wheat bran | Weight (g) | Strain at peak (%) | Stress at peak (MPa) | Young's modulus (MPa) | Cobb 60 |
|---|---|---|---|---|---|---|---|---|
| Ref | — | 20 g (80%) | 5 g (20%) | 21.92 | 2.6 | 17.42 | 989 | 896 |
| Cationic starch (solbond PC170) | 0.3 g | 20 g (80%) | 5 g (20%) | 22.47 | 2.92 | 23.75 | 1275 | — |
| AKD | 0.8 g | 20 g (80%) | 5 g (20%) | | 2.95 | 20.01 | 1108 | 19 |
| Old wheat bran (180827, 0.1% acticide preserved) | 5 g (20%) | 20 g (80%) | | 21.92 | 2.25 | 13.0 | 821.1 | — |
| Dispelair CF58 | 1 g | 20 g (80%) | 5 g (20%) | 22.08 | 2.26 | 12.12 | 820.6 | — |

Different Concentrations of Pre-Treated Wheat Bran and CTMP Pulp.

Different amounts of pre-treated wheat bran was used in the experiments below demonstrated in Table 5. The wheat bran was pre-treated in the standard way by homogenizing for 30 min using an Ika Ultra Turrax at 17.000 rpm with a sodium hydroxide concentration of 0.5%. Different amounts of this pre-treated wheat bran batch was used with CTMP according to the table below. A strength increase is observed with up to 50% wheat bran. Then the strength goes down. Foaming is also increased with increasing wheat bran amount. A too high wheat bran fraction (99%) makes the material too weak and the final hand sheet could not be removed from the paper making wire without falling apart. A drop in weight of the produced hand sheets was also observed. This is caused by the increasing amount of soluble products that do not adsorb to the cellulose fiber.

TABLE 5

| % Wheat bran | CTPM (g) | Wheat bran (g) | Weight (g) | Strain at peak (%) | Stress at peak (MPa) | Young's modulus (MPa) | Comment |
|---|---|---|---|---|---|---|---|
| 0 | 25 | 0 | 24.14 | 2.14 | 11.21 | 760 | |
| 5% | 23.75 | 1.25 | 23.65 | 2.10 | 12.66 | 803 | |
| 10% | 22.5 | 2.5 | 23.16 | 2.04 | 14.20 | 930 | |
| 20% | 20 | 5 | 21.92 | 2.6 | 17.42 | 989 | |
| 50% | 12.5 | 12.5 | 18.89 | 2.77 | 25.6 | 1482 | Foaming |
| 75% | 6.25 | 18.75 | 16.19 | 1.98 | 14.94 | 1064 | Foaming |
| 99% | — | — | — | — | — | — | Sample too weak |

Pre-Treated Oat Husk Powder and the Formation of Birch Kraft Pulp Composites.

Pre-treatment of oat husk was performed in a similar way as the pre-treatment of wheat bran to prepare the bioadditive grinded oat husk in the form of fine powder was mixed in 0.75% NaOH at a water solid ratio of 8:1. Oat husks were grinded to oat powder prior to use but could also be used as the mixing was performed using an Ultra Turrax for 30 min. 12.5 g (dry weight) of this slurry was mixed with 12.5 g of the birch pulp and disintegrated as described in the previous sections. Hand sheets were produced as described and mechanical properties were measured. The Tables 6 and 7, below, describe the ingredients for each sample. Foaming was observed during the usage of oat powder. Therefor a commercially available defoamer was used in these examples.

TABLE 6

| | Amount birch pulp (g) | Oat powder | Additive 1 |
|---|---|---|---|
| 1 | 12.5 g | 112.5 g pre-treated oat powder (12.5 g dry weight) | 1 g Dispelair CF56 |
| 2 | 12.5 g | 12.5 g oat powder | 1 g Dispelair CF56 |
| 3 | 12.5 g | 225 g pre-treated oat powder (25 g dry weight) | 1 g Dispelair CF56 |
| 4 | 12.5 g | 337 g pre-treated oat powder (37 g dry weight, washed and decanted 4 times, solids mixed with birch kraft pulp) | 1 g Dispelair CF56 |

TABLE 7

| | Strain (%) | Stress (Mpa) | Young's modulus (Mpa) |
|---|---|---|---|
| Blank (birch) | 2.35 | 19.21 | 1415.7 |
| 1 | 5.84 | 33.42 | 1471 |
| 2 | 3.69 | 10.97 | 616 |
| 3 | 5.39 | 25.51 | 1084 |
| 4 | 4.19 | 14.73 | 695 |

A strength increase is observed in Table 5 with using 50% pre-treated oat husk powder.

In conclusion, the invention described here is a biocomposite material based on wheat bran and/or oat husk and cellulose. In addition to lowering the costs due to lower usage of fibers an increase in mechanical properties can be obtained by the different pre-treatments, especially the alkaline ones.

The invention claimed is:

1. A process for preparing a biocomposite material comprising a bioadditive from cereal husks and/or brans, said process comprising the steps:

(a) mixing the cereal husk and/or bran with an aqueous alkaline solution with a pH of at least 7, in order to provide a bioadditive, (b) admixing the bioadditive with a dispersion of cellulose pulp to provide a biocomposite material;

(c) diluting the mixture of bioadditive and cellulose pulp to a level of 0.25 to 2% dry fiber;

(d) collecting the diluted mixture in a sieve or on a filter; and (e) thermoforming the collected mixture to form the biocomposite material, thereby curing said biocomposite material.

2. A process for preparing a biocomposite material comprising a bioadditive from cereal husks and/or brans, said process comprising the steps:

(a) mixing the cereal husk and/or bran with an aqueous alkaline solution with a pH of at least 7, in order to provide a bioadditive, (b) collecting a water soluble fraction of the bioadditive from step (a) and admixing the water soluble fraction of the bioadditive with a dispersion of cellulose pulp to provide a biocomposite material; and (c) thermoforming the biocomposite material, thereby curing said biocomposite material.

3. The process according to claim 1, wherein the ratio of cereal husk or bran to aqueous solution in the mixing step (a) is from at least 1:1 to 1:100.

4. The process according to claim 1, wherein the biocomposite material comprises 75% (wt) or less of the bioadditive.

5. The process according to claim 1, wherein the mixing step comprises stirring and/or homogenization wherein the rpm is 30,000 rpm or less.

6. The process according to claim 1, wherein the cereal husk or bran is selected from at least one of wheat brans and oat husks.

7. The process according to claim 1, wherein the alkaline solution of step (a) comprises at least 0.5% (wt) NaOH.

8. The process according to claim 1, comprising adding an additive in at least one of step (a) and step (b), said additive being selected from at least one of cationic starch; AKD (alkylketene dimer); ASA (alkenylsuccinic anhydride); PLA (poly lactic acid); dyes; fillers; pigments; wet strength increasing agents; defoamers; preservatives; and biocides.

9. The process according to claim 1, wherein the biocomposite material comprises 5 to 50% (wt) or less of the bioadditive.

10. The process according to claim 1, wherein the biocomposite material is prepared without the addition of a binder.

11. The process according to claim 1, wherein in step (a), the husk or bran has not been subjected to an acid treatment prior to mixing with the aqueous alkaline solution.

12. The process according to claim 1, wherein in step (a), the husk or bran has not been chemically treated prior to mixing with the aqueous alkaline solution.

* * * * *